US005143371A

United States Patent [19]

Strahan

[11] Patent Number: 5,143,371

[45] Date of Patent: Sep. 1, 1992

[54] GOLFER'S AID

[76] Inventor: Ronald L. Strahan, 2416 Apple Way, Edmond, Okla. 73013

[21] Appl. No.: 832,204

[22] Filed: Feb. 6, 1992

[51] Int. Cl.[5] ..... A47L 13/02; A45F 5/00; A63B 57/00; B26B 1/02

[52] U.S. Cl. ..... 273/32 B; 273/32 A; 273/DIG. 30; 15/105; 15/236.08; 15/236.05; 172/380; 224/918; 224/183; 224/269; 224/901; 30/150

[58] Field of Search ..... 273/32 R, 32 A, 32 B, 273/162 R, 162 D, 162 F, DIG. 30; 172/380, 379; 224/918, 183, 269, 901; 15/236.08, 236.05, 105; 30/150

[56] References Cited

U.S. PATENT DOCUMENTS

| | | | |
|---|---|---|---|
| 1,507,632 | 9/1924 | Taylor | 273/32 B X |
| 3,049,182 | 8/1962 | Pelow | 273/32 B |
| 3,233,802 | 2/1966 | Ludwick | 224/183 |
| 3,310,879 | 3/1967 | Brezezinski et al. | 273/32 B X |
| 3,539,017 | 11/1970 | Johnson | 273/32 B X |
| 3,620,426 | 11/1971 | Hatch | 273/32 B X |
| 3,763,515 | 10/1973 | Voss | 15/105 |
| 3,895,797 | 7/1975 | Moore | 273/32 A |
| 4,063,731 | 12/1977 | Kitay | 273/32 B |
| 4,129,237 | 12/1978 | Grinder | 273/32 A X |
| 4,151,937 | 5/1979 | Jarosh et al. | 273/32 B X |
| 4,530,500 | 7/1985 | Kaymen | 273/32 A |
| 4,535,987 | 8/1985 | Dikoff | 273/32 B |
| 4,627,621 | 12/1986 | Tate | 273/32 B |
| 4,773,159 | 9/1988 | Casazza | 224/269 |
| 5,007,129 | 4/1991 | Hainey | 273/32 B X |
| 5,031,812 | 7/1991 | Gustine | 273/32 A |

*Primary Examiner*—George J. Marlo
*Attorney, Agent, or Firm*—Dunlap, Codding & Lee

[57] ABSTRACT

A golfer's aid having a body in the shape of a clip which can be attached to the belt, pocket or waistband of the user or to a golf bag or other article. A strip of hook and look fabric is attached to the straight outer surface of the body for attaching the user's glove. A blade is rotatably attached to the end of the body. One end of the blade is a divot repair tool and one end is a curved surface for checking the roundness of golf balls. One square tooth and one pointed tooth are provided on the arms of the divot repair tool for cleaning the grooves in the heads of golf clubs. Ball markers may be included with the accessory. The ball markers preferably are equipped with a spot of hook and loop fabric on one the side so that the ball marker can be carried on the hook and loop strip on the body. Alternately, a hole surrounded by a small magnet may be provided in the body above the strip for receiving the spike of a ball marker which is either made of metal or provided with a metal collar. In this way, a ball marker can be carried by inserting the spike through the hole, the magnets providing a secure connection.

9 Claims, 2 Drawing Sheets

GOLFER'S AID

FIELD OF THE INVENTION

The present invention relates to golfing accessories.

SUMMARY OF THE INVENTION

The present invention is directed to a golf accessory. The accessory comprises a body formed by a straight portion and an angled portion and having an open end and a closed end so that the body forms a clip. A strip of hook and loop fabric is attached to the outer surface of the straight portion of the body. The body is sized to be held in the palm of the hand of a user.

An elongate blade is rotatably attached to the straight portion of the body at the open end of the body. The blade has a first end and a second end, and the first end has a U-shaped portion with two arms which is adapted for repairing divots.

The outer edge of one arm of the U-shaped portion may be provided with a pointed tooth sized to be received in V-shaped grooves of golf club heads. The outer edge of the other arm of the U-shaped portion may be provided with a square tooth sized to be received in square grooves of golf club heads.

The second end of the blade may be shaped to define a concave curve having the radius of a golf ball.

The outer surface of the closed end of the body may be shaped to define a concave surface sized to support the handle of a golf club.

In the preferred embodiment a hole is formed in the straight portion of the body near the closed end and a magnet is affixed to the inside surface of the straight portion near the hole. In this way a metal golf ball marker, or a plastic golf ball marker with a metal collar, can be carried on the body by inserting the spike through the hole.

The golf accessory may further include a ball marker comprising a disk with a spot of hook and loop fabric on one side. This disk then can be attached to the strip of hook and loop fabric on the straight portion of the body.

DETAILED DESCRIPTION OF THE PREFERRED EMBODIMENT

Figure 1:
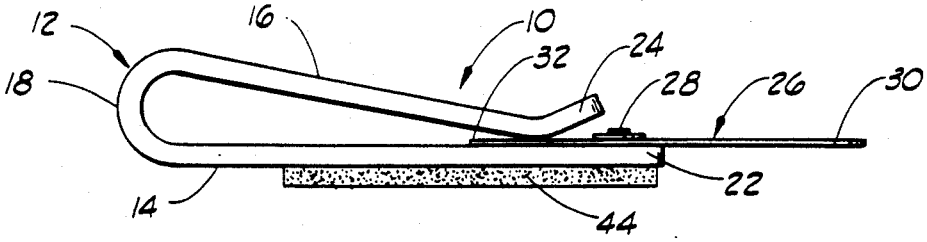
FIG. 1 is a side elevational view of a device constructed in accordance with the present invention.

The present invention is directed to a handy device which greatly aids a golfer in many activities associated with the game of golf. Turning now to the drawings and to FIG. 1 in particular, there is shown therein a device constructed in accordance with the present invention and designated generally by the reference numeral 10.

Figure 5:
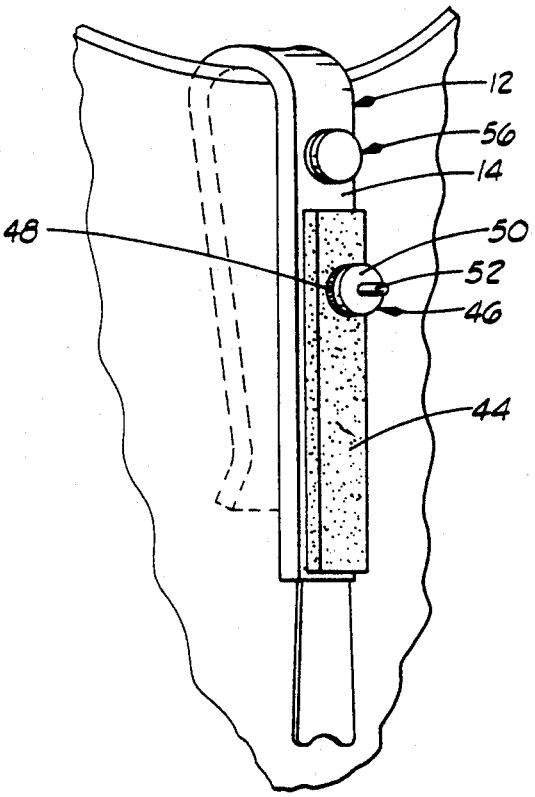
FIG. 5 is an elevational view of the device of the present invention clipped to an article such as a user's pocket and having attached thereto two ball markers.

The device 10 comprises a body 12 by which the device can be clipped to the user's pocket, waistband or belt, as shown in FIG. 5, or to a golf bag or other article. More particularly, the body 12 comprises a straight portion 14 and an opposing angled portion 16 joined at a closed end 18. The end 22 of the straight portion 14 extends slightly beyond the upturned end 24 of the angled portion 16. The body 12 may be made of any slightly flexible material which is water-resistant and durable.

A blade 26 is rotatably attached to the inside of the end 22 of the straight portion 14 at a connecting point 28. The blade 26 preferably is made of some lightweight but relatively rigid material such as aluminum.

Figure 2:
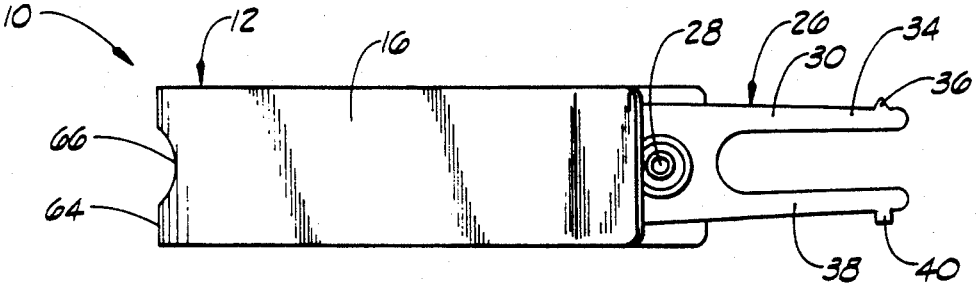
FIG. 2 is a plan view of the device shown in FIG. 1 with the divot repair tool extended.

The blade 26 has a first end 30 and a second end 32. As shown in FIG. 2, the first end 30 of the blade 26 is generally U-shaped to serve as a divot repair tool. On one arm 34 of the first end 30 is a pointed tooth 36, and on the other arm 38 is a square tooth 40. The pointed tooth 36 and the square tooth 40 are sized to be received in the grooves on the heads of golf clubs. Thus, in addition to serving as divot repair tool, the first end 30 of the blade 26 also functions as golf club cleaning device.

Figure 3:
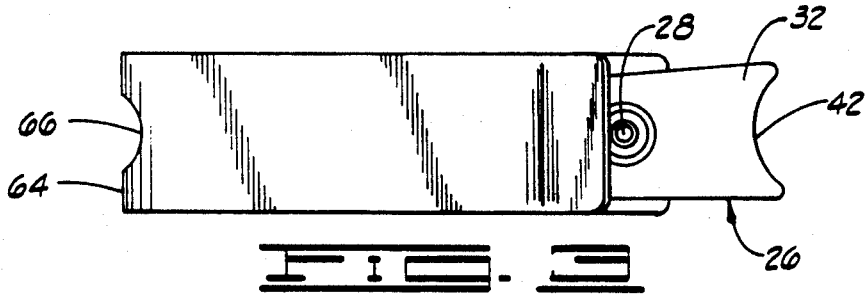
FIG. 3 is a plan view of the device shown in FIG. 1 with the second end of the blade extended.

With reference now to FIG. 3, the first end 30 of the blade 26 can be safely stored by rotating the blade about the connecting point 28 so that the first end 26 is positioned between the straight portion 14 and the curved portion 16 of the body 12. The second end 32, which is exposed while the first end 30 is stored, should be blunt to prevent injury. Preferably, the second end 32 defines a concave edge 42 having a radius equivalent to a golf ball. This provides a tool by which irregularities in the curvature of golf balls can be detected.

Irregularities in a ball's surface can be identified by holding the ball against the curved edge 42. If the ball (not shown) is flush against the edge 42, the surface curvature is correct. If there is a gap at any point between the ball and the edge 42, then the surface curve of the ball is defective and the ball should be replaced. The entire surface of the ball can be inspected by simply rotating the ball at various angles.

Figure 4:
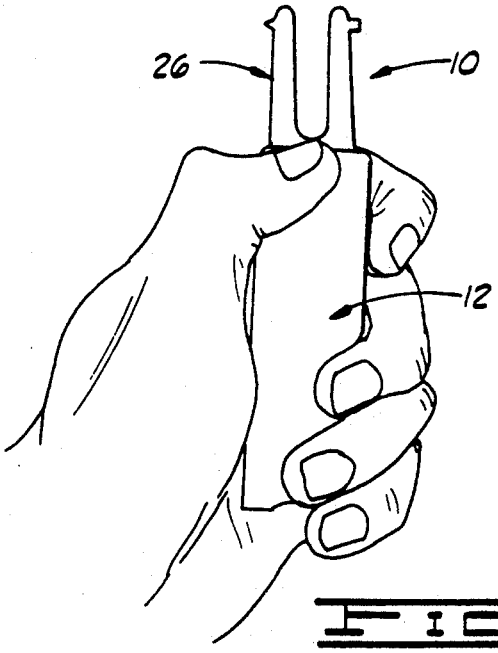
FIG. 4 is an elevational view of the device of this invention held in the hand of a user.

With reference now to FIG. 4, the body 12 should be sized to be gripped comfortably in the palm of the user's hand. In this way, whether the device 10 is being to repair divots or to clean a club head or to inspect a golf ball, the device is manipulated easily with one hand, even by those with arthritis or other joint disorders.

Returning briefly to FIG. 1 and referring also now to FIG. 5, a strip 44 of hook and loop fabric, such as VELCRO brand, is affixed to the outside surface of the straight portion 14 of the body 12. With the device 10 clipped to a pocket, belt or waistband, this strip 40 of hook and loop fabric is accessible and may be used to carry ball markers. To this end, a ball marker 46 with a spot of hook and loop fabric 48 may be provided (FIG. 5). Ball markers of various types are commercially available and may be adapted easily for use with the present invention.

One common type of ball marker is made of plastic and comprises a disk 50 and a spike 52 extending therefrom. By applying a small spot of hook and loop fabric, as shown in FIG. 5, this ball marker 46 can be removably, yet securely attached anywhere the strip 44 where it remains readily accessible when needed.

Figure 6:
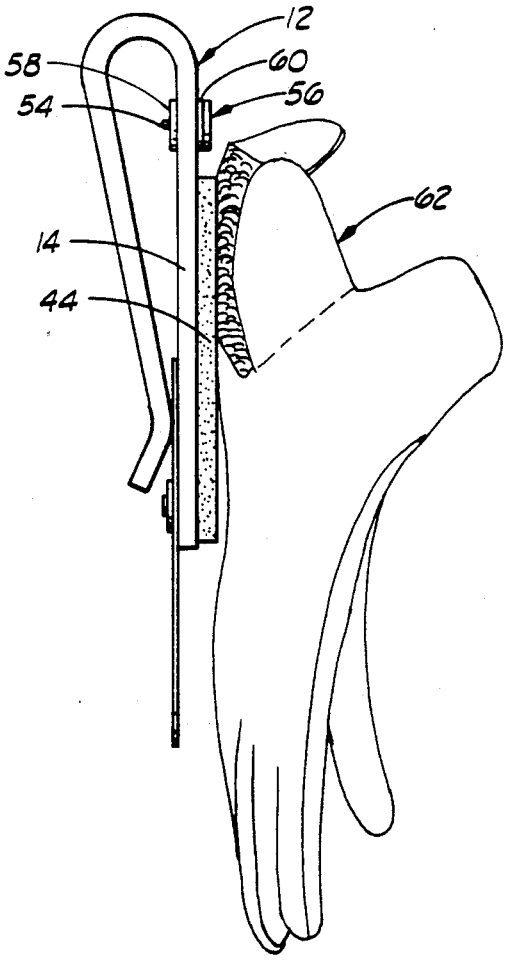
FIG. 6 is a side elevational view of the device having a glove and ball marker attached.

As shown in FIGS. 5 and 6, the body 12 may be provided with a hole in the straight portion 14 of the body 12 for receiving the spike 54 of another ball marker 56. A small magnet 58 is attached to the inside of the straight portion 14 near the hole. A metal ball marker will be attracted to the body 12 and secured thereto by the magnet 58 when the spike is inserted in the hole. Plastic ball markers, such as the marker 56, may be equipped with a piece of metal, such as a ring or collar 60, attached at the base of the spike 54.

As shown in FIG. 6, a golfer's glove 62 may also be conveniently attached to the strip 44. This is more desirable than keeping the glove 62 inside a pocket where no air circulates and where, if it does dry, it will dry wrinkled. While hanging on the device 10 of this invention a glove 62 will dry rapidly and without wrinkles. Moreover, the glove 62 will not blow away or become misplaced as is so likely if the glove is left out on a golf cart or draped over a golf bag.

Figure 7:
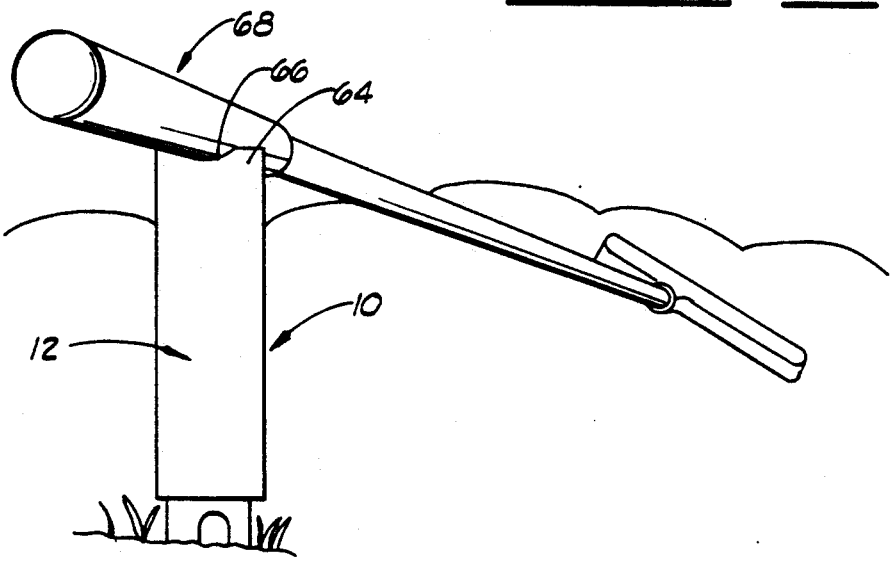
FIG. 7 is a perspective view of the device of the present invention inserted in the ground and supporting the handle of a golf club.

Turning once again to FIGS. 2 and 3 and now also to FIG. 7, the closed end 64 of the body 12 has a concave surface forming a saddle 66. As shown in FIG. 7, the saddle 66 can be positioned vertically by extending the first end 30 of the blade 26 and inserting the first end into the ground. In this position, the saddle 66 will support the handle of a golf club 68. Thus, the device 10 prevents the golfer from having to lay the handle of the club 68 directly on the ground where it might become wet or soiled.

Now it will be understood that the device of the present invention provides a multi-purpose tool which aids a golfer in many ways. The device is lightweight and inexpensive and may be clipped to the golfer's belt, pocket or waistband, or to any convenient article. The device includes a divot repair tool, a club head cleaner, a means for carrying ball markers, and a means for securely attaching a glove where it will dry unwrinkled. The device further includes a tool for checking for defects in the curvature of golf balls. Finally, the device may be used to support the handle of a golf club off the ground so that it is prevented from becoming wet or soiled.

Changes may be made in the combination and arrangement of the various parts, elements, steps and procedures described herein without departing from the spirit and scope of the invention as defined in the following claims.

What is claimed is:

1. A golf accessory comprising:

a flexible body formed by a straight portion and an angled portion overlying said straight portion and having an open end and a closed end so that the body forms a flexible clip, and wherein the body is sized to be held in the palm of the hand of a user;

an elongate blade means for rotatably attaching said blade to the straight portion of the body at the open end of the body, the blade having a first end and a second end, wherein the first end has U-shaped portion with first and second arms which protrude from said open end for repairing divots are stored between said straight and angled portions; and a strip of hook and loop fabric attached to the outer surface of the straight portion of the body.

2. The golf accessory of claim 1 wherein the outer edge of the first arm of the U-shaped portion of the first end of the blade has a pointed tooth sized to be received in V-shaped grooves of golf club heads.

3. The golf accessory of claim 2 wherein the outer edge of the second arm of the U-shaped portion has a square tooth sized to be received in square grooves of golf club heads.

4. The golf accessory of claim 1 wherein the outer edge of the second arm of the U-shaped portion has a square tooth sized to be received in square grooves of golf club heads.

5. The golf accessory of claim 1 wherein the second end of the blade defines a concave curve having the radius of a golf ball whereby defects in the curvature of a golf ball may be detected.

6. The golf accessory of claim 1 wherein the outer surface of the closed end of the body defines a concave surface sized to support the handle of a golf club.

7. The golf accessory of claim 1 wherein the accessory is characterized by a hole in the straight portion of the body near the closed end of the body which hole is sized to receive the spike of a ball marker, wherein the golf accessory further comprises a magnet attached to the inside surface of the straight portion of the body near the hole, and wherein the golf accessory further comprises:

a ball marker comprising:

a disk;

a spike extending perpendicularly from the center of one side of the disk and receivable in the hole in the straight portion of the body; and a piece of metal attached to the disk adjacent the spike.

8. The golf accessory of claim 1 wherein the accessory is characterized by a hole in the straight portion of the body near the closed end of the body which hole is sized to receive the spike of a metal golf ball marker, and wherein the golf accessory further comprises a magnet attached to the inside surface of the straight portion of the body near the hole for attracting the metal golf ball marker.

9. The golf accessory of claim 1 including at least one golf ball marker comprising a disk having a spot of hook and loop fabric on at least one side for removably attaching the golf ball marker to the strip of hook and loop fabric on the straight portion of the body of the golf accessory.

* * * * *